US011619027B1

(12) United States Patent
Bradley et al.

(10) Patent No.: US 11,619,027 B1
(45) Date of Patent: Apr. 4, 2023

(54) SYSTEM FOR CONNECTING DIFFERENT AUXILIARY IMPLEMENTS TO A WORK VEHICLE FOR HYDRAULIC CONTROL AND RELATED AUXILIARY HYDRAULIC MANIFOLD

(71) Applicant: CNH Industrial America LLC, New Holland, PA (US)

(72) Inventors: Nathan John Bradley, Muscatine, IA (US); Ryan Ogg, Mediapolis, IA (US); Michael Vazquez, Hampton, VA (US); Courtney Achen, Mt Pleasant, IA (US); Robert Gerst, Mediapolis, IA (US); Kyler Coates, Willard, UT (US); Andrew Richard Kuntz, Wever, IA (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 17/557,496

(22) Filed: Dec. 21, 2021

(51) Int. Cl.

| | |
|---|---|
| ***E02F 9/22*** | (2006.01) |
| ***F15B 21/00*** | (2006.01) |
| ***F15B 13/08*** | (2006.01) |
| ***E02F 3/36*** | (2006.01) |

(52) U.S. Cl.
CPC ..... *E02F 9/2267* (2013.01); *E02F 3/3654* (2013.01); *E02F 9/2217* (2013.01); *E02F 9/2285* (2013.01); *F15B 13/0814* (2013.01); *F15B 21/003* (2013.01); *F15B 2211/329* (2013.01)

(58) Field of Classification Search
CPC .... F15B 13/0814; F15B 21/003; E02F 9/2267
See application file for complete search history.

(56) References Cited

U.S. PATENT DOCUMENTS

| | | | | |
|---|---|---|---|---|
| 3,680,589 A * | 8/1972 | Jeans | F15B 13/0896 | 137/271 |
| 3,756,274 A * | 9/1973 | Wolfgramm | F15B 13/0896 | 137/271 |
| 3,806,088 A * | 4/1974 | Stoneman | F15B 13/0821 | 137/884 |
| 4,301,832 A * | 11/1981 | Smith | F15B 13/02 | 91/530 |

(Continued)

FOREIGN PATENT DOCUMENTS

WO WO 2020/150179 7/2020

*Primary Examiner* — Michael Leslie
(74) *Attorney, Agent, or Firm* — Peter Zacharias; Patrick Sheldrake

(57) ABSTRACT

An auxiliary hydraulic manifold for connecting different implements to a work vehicle for hydraulic control may include a housing, a plurality of vehicle-side ports in the housing including a first vehicle-side port, and a plurality of implement-side ports in the housing including a first implement-side port fluidly coupled to the first vehicle-side port and a second implement-side port fluidly coupled to the first vehicle-side port. A number of the plurality of implement-side ports is greater than a number of the plurality of vehicle-side ports. Additionally, the auxiliary hydraulic manifold may include a pilot-operated check valve fluidly coupled between the first vehicle-side port and the first implement-side port.

18 Claims, 5 Drawing Sheets

(56) References Cited

U.S. PATENT DOCUMENTS

| | | | | |
|---|---|---|---|---|
| 4,723,576 | A * | 2/1988 | Raymond | F15B 13/0835 137/884 |
| 5,056,415 | A * | 10/1991 | Karakama | F15B 13/0807 91/461 |
| 6,379,075 | B1 | 4/2002 | Shamblin et al. | |
| 6,644,169 | B2 * | 11/2003 | Deininger | F15B 13/0896 137/596.17 |
| 9,303,662 | B2 * | 4/2016 | Merth | F15B 13/0814 |
| 9,404,235 | B2 | 8/2016 | Van Hooft et al. | |
| 9,631,755 | B2 | 4/2017 | Behr et al. | |
| 9,976,659 | B2 | 5/2018 | Preston et al. | |
| 10,197,201 | B2 | 2/2019 | Ferrara et al. | |
| 2009/0321154 | A1 * | 12/2009 | Johnson | B60P 1/42 180/53.4 |
| 2020/0217040 | A1 | 7/2020 | Hill et al. | |

* cited by examiner

SYSTEM FOR CONNECTING DIFFERENT AUXILIARY IMPLEMENTS TO A WORK VEHICLE FOR HYDRAULIC CONTROL AND RELATED AUXILIARY HYDRAULIC MANIFOLD

FIELD OF THE INVENTION

The present disclosure relates generally to work vehicles and, more particularly, to a system for connecting different auxiliary implements to a work vehicle and to a related auxiliary hydraulic manifold.

BACKGROUND OF THE INVENTION

A work vehicle, such as a construction vehicle, an agricultural vehicle, or the like, generally includes a hydraulic system to actuate various components of the vehicle. For example, the hydraulic system may be configured to raise and lower an implement, such as a bucket, at the operator's command. In some instances, in addition to the main implement of the work vehicle, the work vehicle may also be configured to support an auxiliary implement. For instance, the main implement, such as a bucket, may be supported at a front end of the work vehicle while an auxiliary implement, such as a winch or ripper, may be supported at a rear end of the work vehicle. The hydraulic system may therefore also include an auxiliary hydraulic circuit configured to allow control of the auxiliary implement.

However, not all auxiliary implements have the same hydraulic configuration. For instance, some auxiliary implements, such as a ripper, may not have a hydrostatic motor, so check valves are required to keep the implement in the desired vertical position when the work vehicle is turned off. Other auxiliary implements, such as winches, may have hydrostatic motors and thus, do not require check valves, among other things. As such, when an operator wishes to switch between auxiliary implements with different hydraulic configurations, the operator has to reconfigure the auxiliary hydraulic circuit on the work vehicle, which is time consuming.

Accordingly, a system for connecting different auxiliary implements to a work vehicle would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a system for connecting different implements to a work vehicle for hydraulic control. The system may include a work vehicle having a plurality of hydraulic auxiliary control lines and an auxiliary hydraulic manifold hydraulically couplable to the work vehicle. The auxiliary hydraulic manifold may have a plurality of vehicle-side ports and a plurality of implement-side ports, where each of the plurality of vehicle-side ports is fluidly coupled to a respective one of the plurality of hydraulic auxiliary control lines, and where each of the plurality of vehicle-side ports is fluidly coupled to at least one respective implement-side port of the plurality of implement-side ports. A first set of the plurality of implement-side ports may be configured to be fluidly coupled to a first work implement, while a second set of the plurality of implement-side ports may be configured to be fluidly coupled to a second work implement, where at least one of the first set of the plurality of implement-side ports is different from the second set of the plurality of implement-side ports.

In another aspect, the present subject matter is directed to an auxiliary hydraulic manifold for connecting different implements to a work vehicle for hydraulic control. The auxiliary hydraulic manifold may include a housing, a plurality of vehicle-side ports in the housing, with the plurality of vehicle-side ports including a first vehicle-side port, and a plurality of implement-side ports in the housing, with the plurality of implement-side ports including a first implement-side port fluidly coupled to the first vehicle-side port and a second implement-side port fluidly coupled to the first vehicle-side port. Generally, a number of the plurality of implement-side ports is greater than a number of the plurality of vehicle-side ports. Additionally, the auxiliary hydraulic manifold may include a pilot-operated check valve fluidly coupled between the first vehicle-side port and the first implement-side port.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
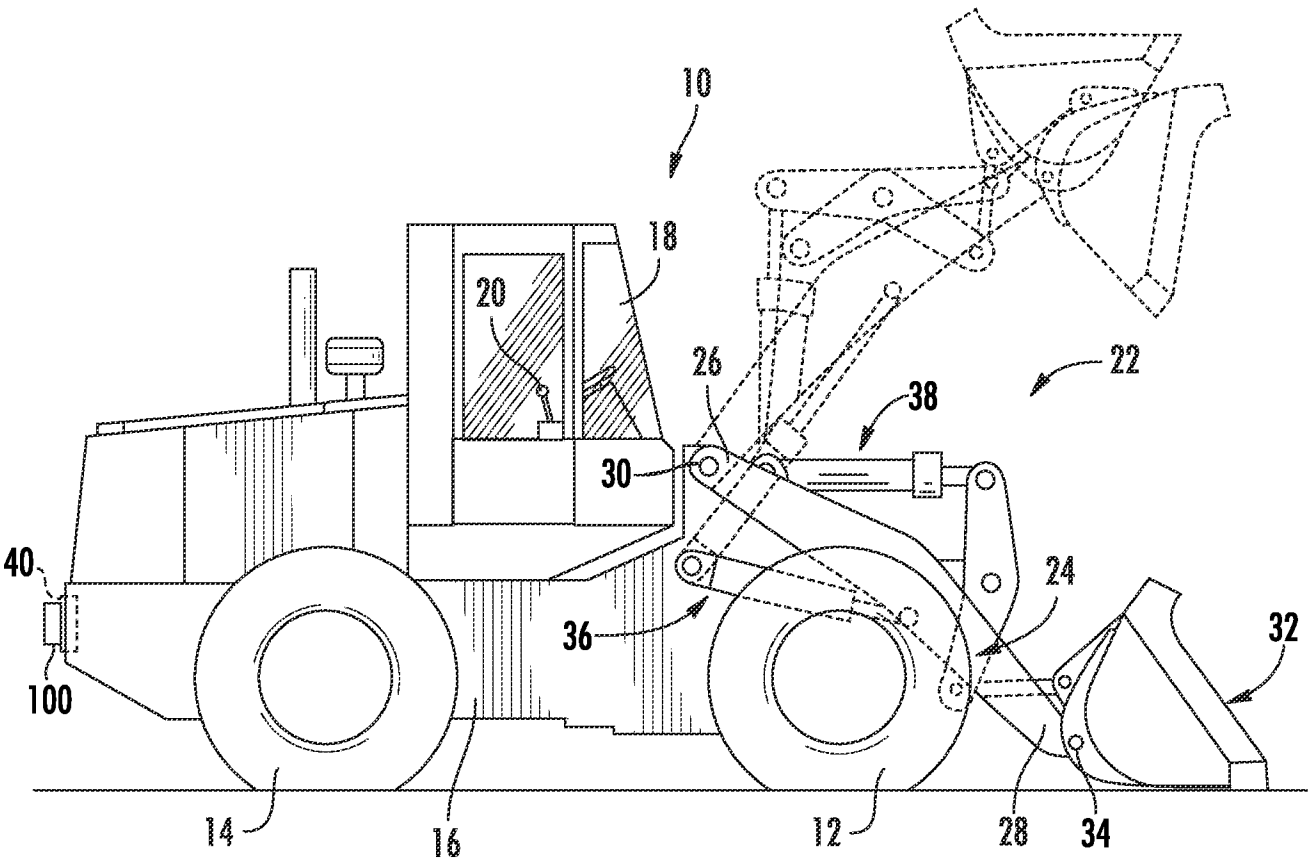
FIG. 1 illustrates a side view of one embodiment of a work vehicle in accordance with aspects of the present subject matter.

Repeat use of reference characters in the present specification and drawings is intended to represent the same or analogous features or elements of the present technology.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a system for connecting different auxiliary implements to a work vehicle and to a related auxiliary hydraulic manifold. As will be described in greater detail below, the work vehicle includes an auxiliary hydraulic circuit having a plurality of hydraulic auxiliary control lines which may be used to hydraulically control an auxiliary implement coupled to the work vehicle. An auxiliary hydraulic manifold is coupled to the auxiliary hydraulic circuit of the work vehicle, such that auxiliary implements are couplable to the auxiliary hydraulic manifold, instead of directly to the auxiliary hydraulic circuit of the work vehicle. More particularly, the auxiliary hydraulic manifold has a plurality of vehicle-side ports, which are fluidly couplable to the hydraulic auxiliary control lines of the auxiliary hydraulic circuit of the work vehicle, and a plurality of implement-side ports which are fluidly couplable to the auxiliary implements, where each of the plurality of vehicle-side ports is fluidly coupled to at least one respective implement-side port of the plurality of implement-side ports. Particularly, the implement-side ports of the auxiliary hydraulic manifold include a first set of implement-side ports that are configured to couple to auxiliary implements having a first hydraulic configuration and a second set of implement-side ports that are configured to couple to auxiliary implements having a second hydraulic configuration, where at least one of the first set of implement-side ports differs from the second set of implement-side ports. When an operator wishes to switch from an auxiliary implement of the first hydraulic configuration to an auxiliary implement of the second hydraulic configuration, the operator simply disconnects the auxiliary implement having the first type of hydraulic configuration from the first set of implement-side ports and connects the auxiliary implement having the second type of hydraulic configuration to the second set of implement-side ports, without having to change the connection between the auxiliary hydraulic manifold and the auxiliary hydraulic circuit of the work vehicle. As such, the auxiliary hydraulic manifold significantly reduces the amount of time it takes to switch between auxiliary implements having different hydraulic configurations.

Referring now to the drawings. FIG. 1 illustrates a side view of one embodiment of a work vehicle 10. As shown, the work vehicle 10 is configured as a wheel loader. However, in other embodiments, the work vehicle 10 may be configured as any other suitable work vehicle known in the art, such as any other construction vehicle (e.g., another type of loader, a dozer, a grader, etc.), an agricultural vehicle (e.g., a tractor, a harvester, a sprayer, etc.), or the like.

As shown in FIG. 1, the work vehicle 10 includes a pair of front wheels 12, a pair or rear wheels 14, and a chassis 16 coupled to and supported by the wheels 12, 14. An operator's cab 18 may be supported by a portion of the chassis 16 and may house various control or input devices (e.g., levers, pedals, control panels, buttons and/or the like) for permitting an operator to control the operation of the work vehicle 10. For instance, as shown in FIG. 1, the work vehicle 10 includes one or more joysticks or control levers 20 for controlling the operation of one or more components of a lift assembly 22 of the work vehicle 10.

As shown in FIG. 1, the lift assembly 22 is positioned proximate the front of the work vehicle and includes a pair of loader arms 24 (one of which is shown) extending lengthwise between a first end 26 and a second end 28. In this respect, the first ends 26 of the loader arms 24 may be pivotably coupled to the chassis 16 at pivot joints 30. Similarly, the second ends 28 of the loader arms 24 may be pivotably coupled to a suitable implement 32 of the work vehicle 10 (e.g., a bucket, fork, blade, and/or the like) at pivot joints 34. In addition, the lift assembly 22 also includes a plurality of hydraulic actuators for controlling the movement of the loader arms 24 and the implement 32. For instance, the lift assembly 22 may include a pair of hydraulic lift cylinders 36 (one of which is shown) coupled between the chassis 16 and the loader arms 24 for raising and lowering the loader arms 24 relative to the ground. Moreover, the lift assembly 22 may include a pair of hydraulic tilt cylinders 38 (one of which is shown) for tilting or pivoting the implement 32 relative to the loader arms 24.

Figure 2A:
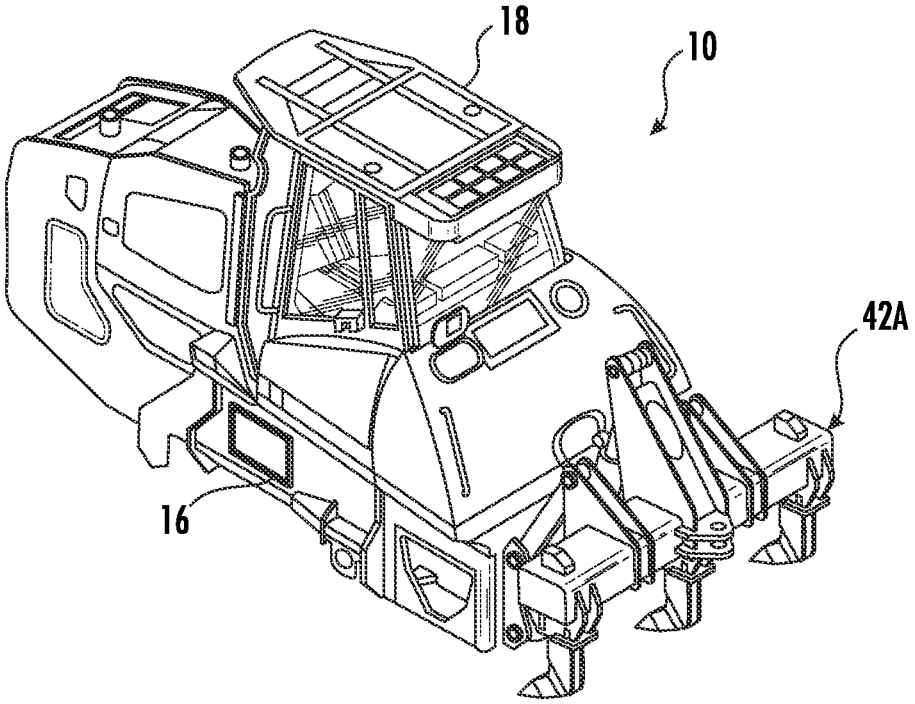
FIG. 2A illustrates a side view of a work vehicle with an auxiliary implement having a first type of hydraulic configuration coupled thereto in accordance with aspects of the present subject matter.
Figure 2B:
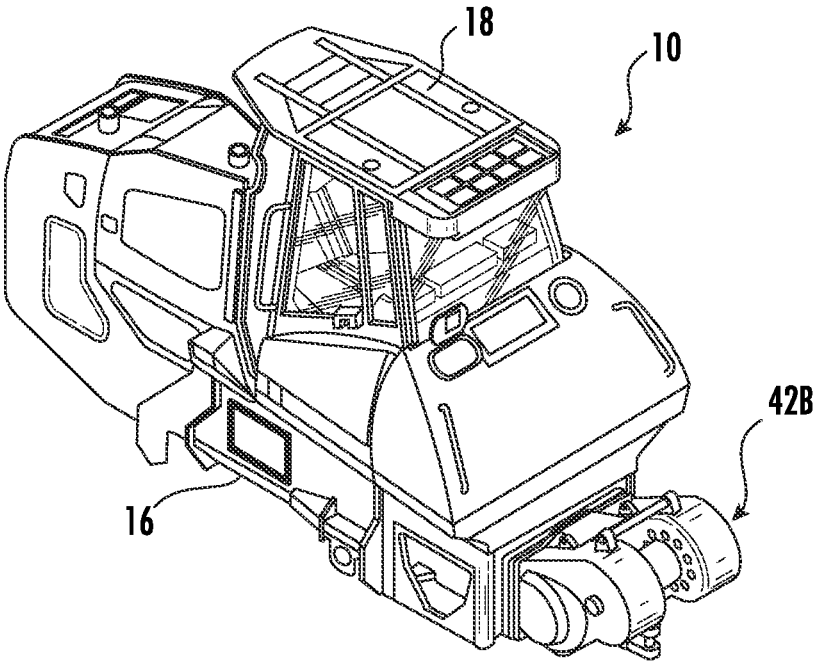
FIG. 2B illustrates a side view of a work vehicle with an auxiliary implement having a second type of hydraulic configuration coupled thereto in accordance with aspects of the present subject matter.

The work vehicle 10 may be configured as an auxiliary-ready work vehicle which includes an auxiliary hydraulic circuit 40 that allows the work vehicle 10 to hydraulically control an auxiliary implement coupled thereto. For instance, as shown in FIGS. 2A and 2B, auxiliary implements, such as a ripper 42A (FIG. 2A) and a winch 42B (FIG. 2B) may be alternately connectable to the work vehicle 10 and controlled via the auxiliary hydraulic circuit 40. In one embodiment, as shown in FIG. 1, the auxiliary hydraulic circuit 40 may be positioned at the rear end of the work vehicle 10, opposite end from the lift assembly 22. However, the auxiliary hydraulic circuit 40 may be positioned at any other suitable location on the work vehicle 10.

As will be described in greater detail below, in accordance with aspects of the present subject matter, an auxiliary hydraulic manifold 100 may be coupled to the auxiliary hydraulic circuit 40 to allow auxiliary implements having different hydraulic configurations, such as the ripper 42A and the winch 42B, to be alternately couplable to the auxiliary hydraulic circuit 40 without requiring the auxiliary hydraulic circuit 40 to be reconfigured.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration. For instance, some configurations may rely on tracks in lieu of the wheels 12, 14, and/or may use an articulated chassis to steer the work vehicle 10.

Figure 3A:
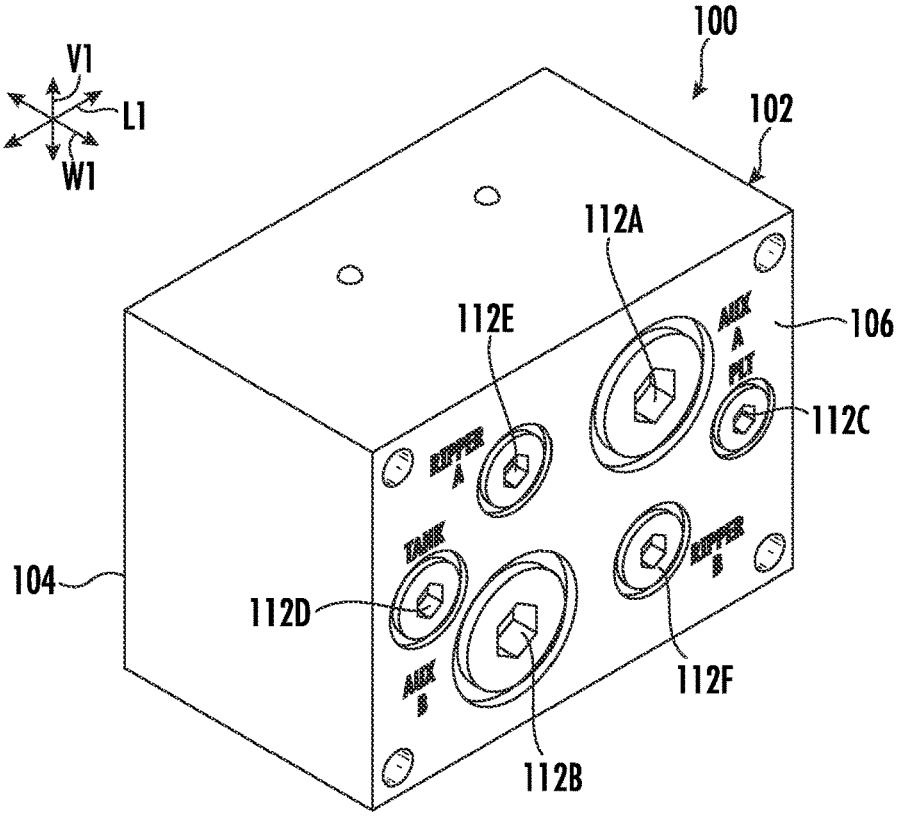
FIG. 3A illustrates a perspective view of an auxiliary hydraulic manifold for use with a work vehicle and different auxiliary implement types in accordance with aspects of the present subject matter, particularly illustrating an implement-side of the auxiliary hydraulic manifold.
Figure 3B:
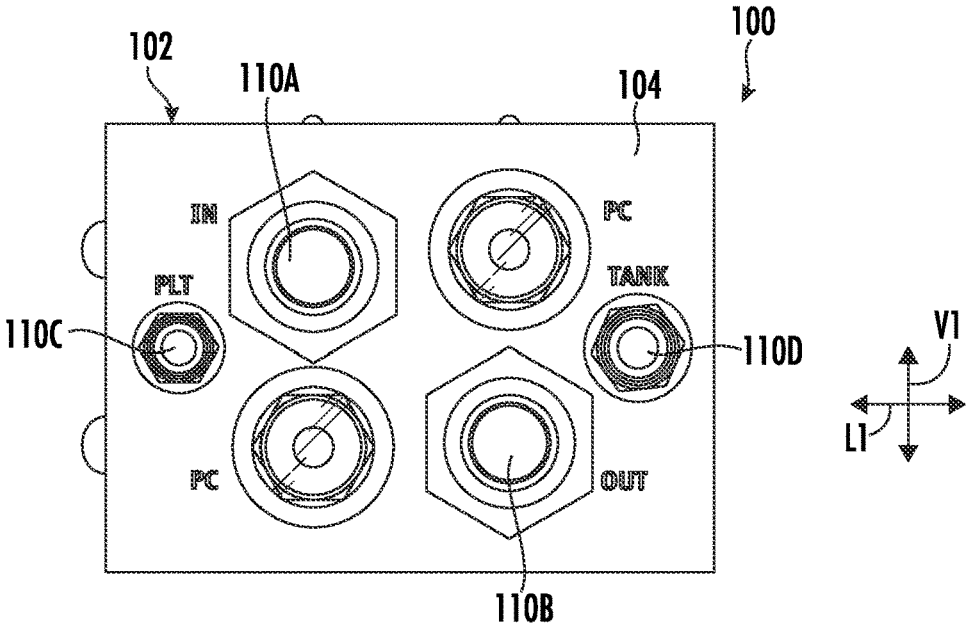
FIG. 3B illustrates a rear view of the auxiliary hydraulic manifold shown in FIG. 3A in accordance with aspects of the present subject matter, particularly illustrating a vehicle-side of the auxiliary hydraulic manifold.
Figure 4:
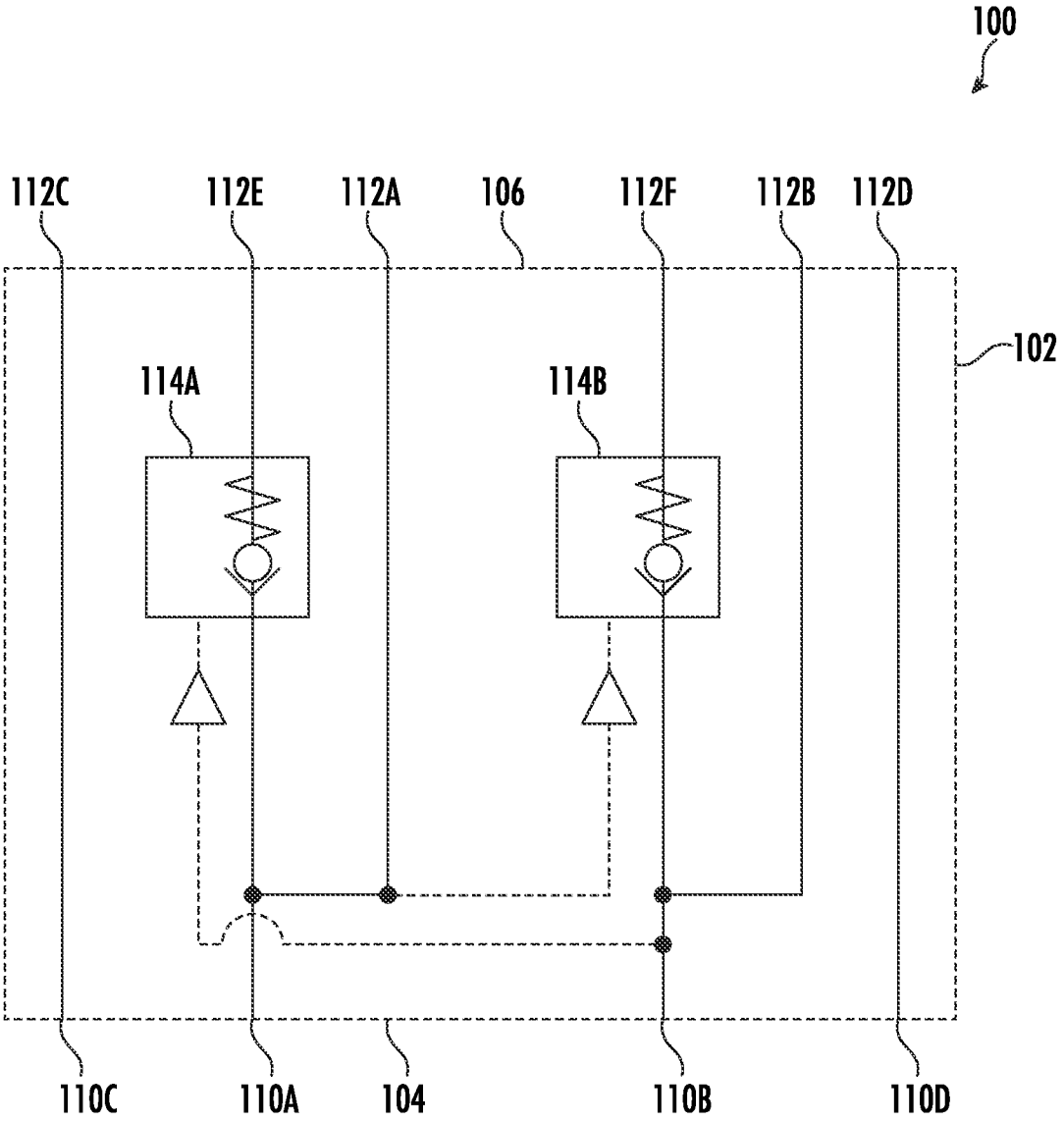
FIG. 4 illustrates a schematic view of the hydraulic manifold shown in FIGS. 3A and 3B in accordance with aspects of the present subject matter.

Referring now to FIGS. 3A-4, various views of an auxiliary hydraulic manifold (e.g., the auxiliary hydraulic manifold 100) for use with a work vehicle (e.g., the work vehicle 10) and different auxiliary implement types (e.g., the ripper 42A and the winch 42B) are illustrated in accordance with aspects of the present subject matter. More particularly. FIG. 3A illustrates a perspective view of the auxiliary hydraulic manifold 100, particularly illustrating an implement-side of the auxiliary hydraulic manifold 100. Further, FIG. 3B illustrates a rear view of the auxiliary hydraulic manifold 100 shown in FIG. 3A, particularly illustrating a vehicle-side of the auxiliary hydraulic manifold 100. Additionally, FIG. 4 illustrates a schematic view of the hydraulic manifold 100 shown in FIGS. 3A and 3B.

As shown in FIGS. 3A-3B, the auxiliary hydraulic manifold 100 includes a housing 102 that defines a vehicle side 104 and an implement side 106. In one embodiment, the vehicle side 104 and the implement side 106 are spaced apart. For instance, the vehicle and implement sides 104, 106 are shown as being spaced apart along a width direction W1 of the housing 102 such that the vehicle side 104 is on an opposite side of the housing 102 from the implement side 106. However, it should be appreciated that the vehicle and implement sides 104, 106 may be spaced apart in any suitable manner. For instance, the vehicle and implement sides 104, 106 may be alternatively or additionally spaced apart in a vertical direction V1 and/or in a lateral direction L1, may be oriented at 90 degrees relative to each other, and/or the like.

The auxiliary hydraulic manifold 100 further includes a plurality of vehicle-side ports on or accessible from the vehicle side 104 of the housing 102 and a plurality of implement-side ports on or accessible from the implement side 106 of the housing 102. Particularly, as shown in FIG. 3B, the plurality of vehicle-side ports includes a vehicle-side inlet port 110A, a vehicle-side outlet port 110B, a vehicle-side pilot port 110C, and a vehicle-side tank port 110D. Similarly, as shown in FIG. 3A, the plurality of implement-side ports includes a first implement-side auxiliary port 112A, a second implement-side auxiliary port 112B, an implement-side pilot port 112C, an implement-side tank port 112D, a first implement-side check port 112E, and a second implement-side check port 112F. A number of the plurality of implement-side ports is generally greater than a number of the plurality of vehicle-side ports.

As particularly shown in FIG. 4, each of the vehicle-side ports 110A, 110B, 110C, 110D is fluidly coupled to at least one respective implement-side port of the implement-side ports 112A, 112B, 112C, 112D, 112E, 112F. For instance, the vehicle-side inlet port 110A is fluidly coupled to the first implement-side auxiliary port 112A and to the first implement-side check port 112E. More particularly, the first implement-side auxiliary port 112A and the first implement-side check port 112E are coupled in parallel to the vehicle-side inlet port 110A, with a first check valve 114A being fluidly coupled between the vehicle-side inlet port 110A and the first implement-side check port 112E. Similarly, the vehicle-side outlet port 110B is fluidly coupled to the second implement-side auxiliary port 112B and to the second implement-side check port 112F. More particularly, the second implement-side auxiliary port 112B and the second implement-side check port 112F are coupled in parallel to the vehicle-side outlet port 110B, with a second check valve 114B being fluidly coupled between the vehicle-side outlet port 110B and the second implement-side check port 112F. Moreover, the vehicle-side pilot port 110C is fluidly coupled to the implement-side pilot port 112C. Additionally, the vehicle-side tank port 110D is fluidly coupled to the implement-side tank port 112D. It should be appreciated that the first and second check valves 114A, 114B may be pilot-operated check valves or may be configured as any other suitable type, or combination of types, of check valves, such as a solenoid-operated check valve and/or the like.

As will be described in greater detail below, the vehicle-side ports 110A, 110B, 110C, 110D are configured to be fluidly couplable to hydraulic auxiliary control lines of the auxiliary hydraulic circuit 40 while the implement-side ports 112A, 112B, 112C, 112D, 112E, 112F are configured to be fluidly couplable to auxiliary implements. More particularly, the implement-side ports 112A, 112B, 112C, 112D, 112E, 112F includes a first set of implement-side ports (e.g., the first implement-side check port 112E and the second implement-side check port 112F) configured to be couplable to an auxiliary implement (e.g., the ripper 42A) having a first type of hydraulic configuration and a second set of implement-side ports (e.g., the first implement-side auxiliary port 112A, the second implement-side auxiliary port 112B, the implement-side pilot port 112C, and the implement-side tank port 112D) configured to be couplable to an auxiliary implement (e.g., the winch 42B) having a second type of hydraulic configuration. For instance, in one embodiment, the first set of the implement-side ports includes only the first implement-side check port 112E and the second implement-side check port 112F while the second set of the implement-side ports includes only the first implement-side auxiliary port 112A, the second implement-side auxiliary port 112B, the implement-side pilot port 112C, and the implement-side tank port 112D. However, it should be appreciated that, in other embodiments, the first set of implement-side ports may include any other suitable implement-side port(s) and/or the second set of implement-side ports may include any other suitable implement-side port(s). Moreover, it should be appreciated that, in one embodiment, at least one of the first set of the plurality of implement-side ports is different from the second set of the plurality of implement-side ports. However, in some embodiments, each of the first set of the plurality of implement-side ports is different from the second set of the plurality of implement-side ports.

Figure 5B:
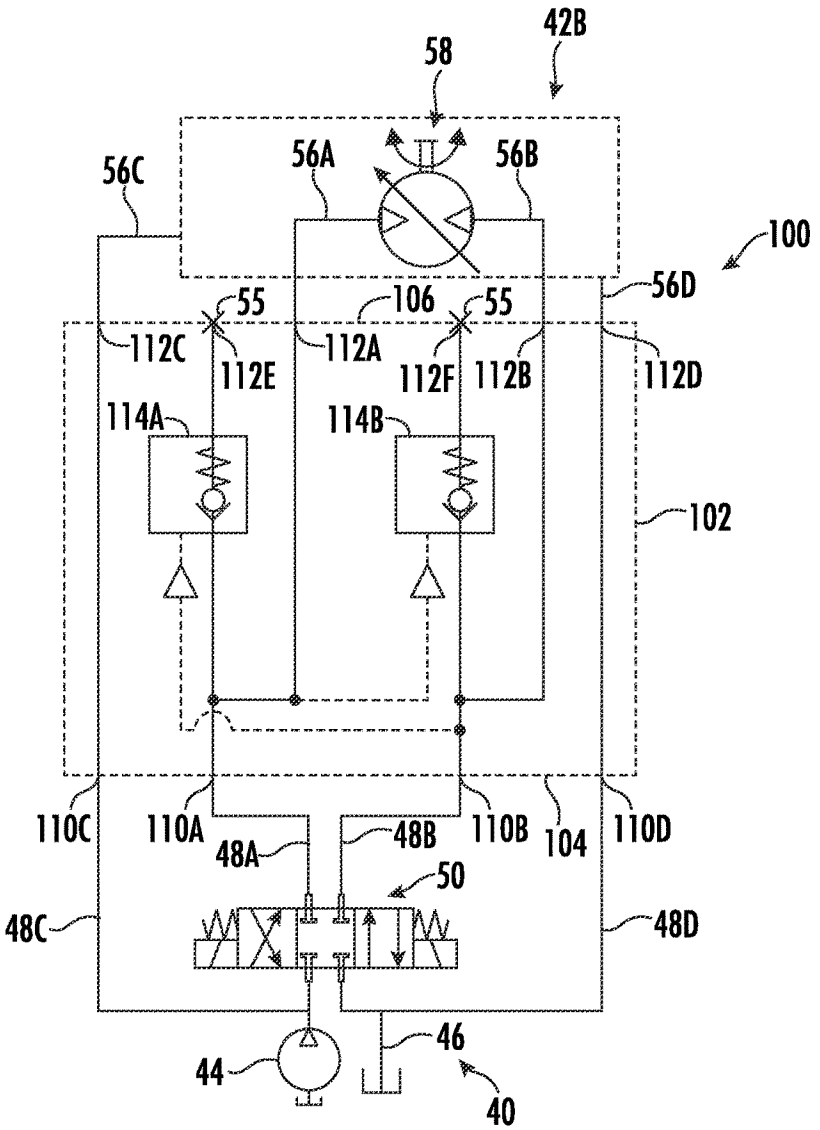
FIG. 5B illustrates another schematic view of a system having the hydraulic manifold shown in FIGS. 3A-4 in accordance with aspects of the present subject matter, particularly illustrating the hydraulic manifold hydraulically coupled between a work vehicle and an auxiliary implement having a second type of hydraulic configuration.
Figure 5A:
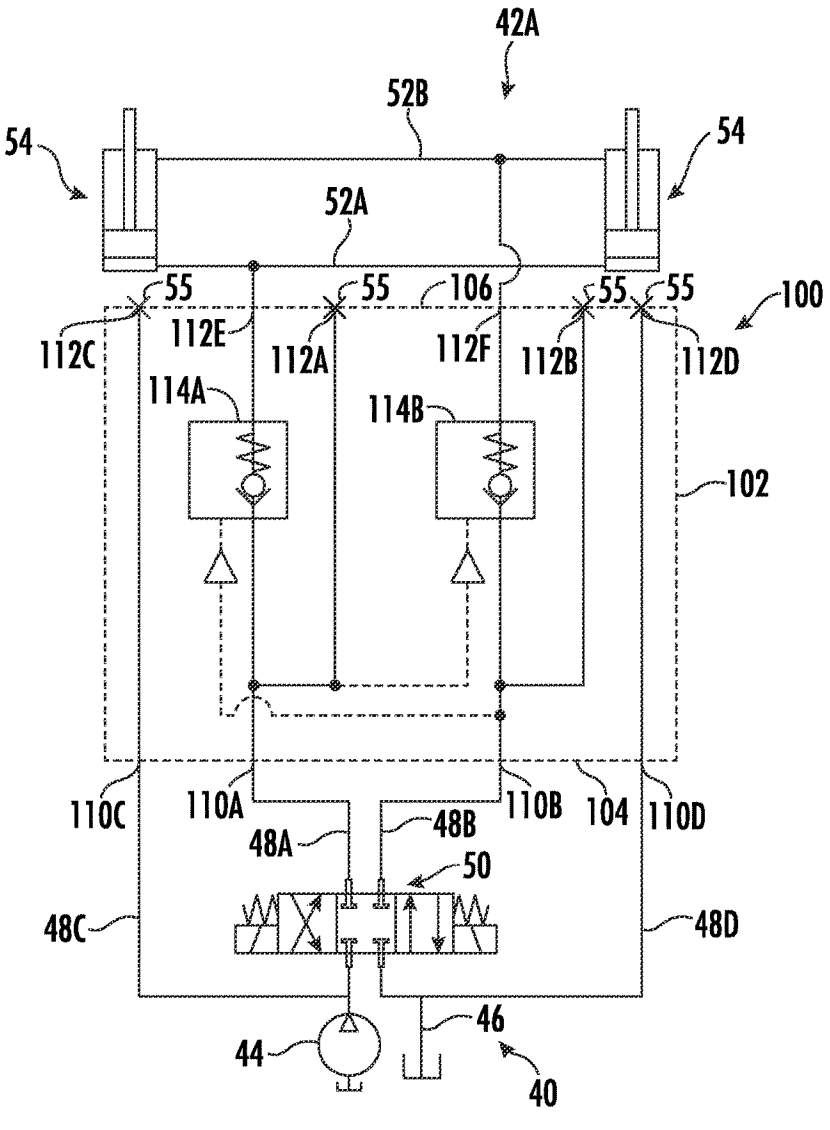
FIG. 5A illustrates a schematic view of a system having the hydraulic manifold shown in FIGS. 3A-4 in accordance with aspects of the present subject matter, particularly illustrating the hydraulic manifold hydraulically coupled between a work vehicle and an auxiliary implement having a first type of hydraulic configuration.

For instance, referring now to FIGS. 5A and 5B, differing schematic views of a system having the hydraulic manifold 100 shown in FIGS. 3A-4 are illustrated in accordance with aspects of the present subject matter, where FIG. 5A particularly illustrates the hydraulic manifold 100 hydraulically coupled between a work vehicle (e.g., work vehicle 10) and an auxiliary implement having a first type of hydraulic configuration and FIG. 5B illustrates the hydraulic manifold 100 hydraulically coupled between a work vehicle (e.g., work vehicle 10) and an auxiliary implement having a second type of hydraulic configuration.

As shown in FIGS. 5A and 5B, the auxiliary hydraulic circuit 40 of the work vehicle 10 includes a pump 44 configured to pump hydraulic fluid from a reservoir or tank 46. The auxiliary hydraulic circuit 40 further includes a plurality of hydraulic auxiliary control lines including an inlet auxiliary control line 48A, an outlet auxiliary control line 48B, a pilot auxiliary control line 48C, and a tank auxiliary control line 48D. Each of the auxiliary control lines 48A, 48B, 48C, 48D are configured to be hydraulically coupled to a respective one of the vehicle-side ports 110A, 110B, 110C, 110D. For instance, the inlet auxiliary control line 48A is hydraulically coupled to the vehicle-side inlet port 110A, the outlet auxiliary control line 48B is hydraulically coupled to the vehicle-side outlet port 110B, the pilot auxiliary control line 48C is hydraulically coupled to the vehicle-side pilot port 110C, and the tank auxiliary control line 48D is hydraulically coupled to the vehicle-side tank port 110D.

The pilot auxiliary control line 48C is hydraulically coupled to the pump 44 and the tank auxiliary control line 48D is hydraulically coupled to the tank 46, while the auxiliary hydraulic circuit 40 additionally includes an auxiliary control valve 50 for controlling the connection between the inlet and outlet auxiliary control lines 48A, 48B, the pump 44, and the tank 46. For instance, in a first position of the auxiliary control valve 50, as shown in FIGS. 5A and 5B, the inlet auxiliary control line 48A and the outlet auxiliary control line 48B are not connected to the pump 44 or the tank 46. In a second position of the auxiliary control valve 50, the inlet auxiliary control line 48A is hydraulically coupled to the pump 44 and the outlet auxiliary control line 48B is hydraulically coupled to the tank 46. Conversely, in a third position of the auxiliary control valve 50, the inlet auxiliary control line 48A is hydraulically coupled to the tank 46 and the outlet auxiliary control line 48B is hydraulically coupled to the pump 44. The auxiliary control valve 50 may be configured as a solenoid operated control valve. However, in other embodiments, the auxiliary control valve 50 may be configured as any other suitable type of valve.

An auxiliary implement, such as the ripper 42A, having a first type of hydraulic configuration is shown in FIG. 5A as being coupled to the auxiliary hydraulic manifold 100. In one embodiment, the auxiliary implement 42A has a first actuator auxiliary supply line 52A and a second auxiliary actuator supply line 52B. The first actuator auxiliary supply line 52A is hydraulically coupled to a first side of each of the auxiliary implement actuators 54, while the second auxiliary supply line 52B is hydraulically coupled to a second, opposite side of each of the auxiliary implement actuators 54, where the auxiliary implement actuators 54 may be configured to raise and lower the ripper 42A. The actuator auxiliary supply lines 52A, 52B are configured to be coupled to the first set of implement-side ports 112E, 112F. More particularly, the first actuator auxiliary supply line 52A is hydraulically coupled to the first implement-side check port 112E and the second auxiliary supply line 52B is hydraulically coupled to the second implement-side check port 112F. As the second set of implement-side ports 112A, 112B, 112C, 112D are not in use, the second set of implement-side ports 112A, 112B, 112C, 112D are blocked off by plugs 55 receivable in the ports 112A, 112B, 112C, 112D.

With the ripper 42A coupled to the auxiliary hydraulic manifold 100, the control valve 50 of the vehicle 10 can control the operation of the auxiliary implement 42A. For instance, when the control valve 50 is in the first position (shown), the auxiliary implement actuators 54 are held in their current position and the check valves 114A. 114B prevent leakage of the hydraulic fluid from the implement actuators 54. When the control valve 50 is in the second position, hydraulic fluid is fed from the pump 44 through the inlet auxiliary control line 48A, the vehicle-side inlet port 110A, the first check valve 114A, the first implement-side check port 112E, and the first actuator auxiliary supply line 52A to the first side of each of the auxiliary implement actuators 54. Due to the pilot pressure from the vehicle-side inlet port 110A opening the second check valve 114B, hydraulic fluid from the second side of each of the auxiliary implement actuators 54 is allowed to drain via the second auxiliary actuator supply line 52B, the second implement-side check port 112F, the second check valve 114B, the vehicle-side outlet port 110B, and the outlet auxiliary control line 48B to the tank 46. Conversely, when the control valve is in the third position, hydraulic fluid is fed from the pump 44 through the outlet auxiliary control line 48B, the vehicle-side outlet port IO 0B, the second check valve 114B, second implement-side check port 112F, and the second auxiliary actuator supply line 52B to the second side of each of the auxiliary implement actuators 54. Due to pilot pressure from the vehicle-side outlet port 110B opening the first check valve 114A, hydraulic fluid from the first side of each of the auxiliary implement actuators 54 is allowed to drain via the first auxiliary actuator supply line 52A, the first implement-side check port 112E, the first check valve 114A, the vehicle-side inlet port 110A, and the inlet auxiliary control line 48A to the tank 46. Generally, the ripper 42A may be raised when fluid is supplied to the first sides of the auxiliary implement actuators 54 and the ripper 42A may be lowered when fluid is supplied to the second sides of the auxiliary implement actuators 54, or vice versa.

It should be appreciated that while the ripper 42A is shown as having two auxiliary implement actuators 54, the ripper 42A may have any other suitable number of auxiliary implement actuators 54, such as one, three, or more auxiliary implement actuators 54.

An auxiliary implement, such as the winch 42B, having a second type of hydraulic configuration is shown in FIG. 5B as being coupled to the auxiliary hydraulic manifold 100. In one embodiment, the auxiliary implement 42B has a first hydrostatic supply line 56A configured to be coupled to the first implement-side auxiliary port 112A, a second hydrostatic supply line 56B configured to be coupled to the second implement-side auxiliary port 112B, a pilot supply line 56C configured to be coupled to the implement-side pilot port 112C, and a tank supply line 56D configured to be coupled to the implement-side tank port 112D. Supply of hydraulic fluid through the first and second hydrostatic supply lines 56A, 56B controls a direction of rotation of the hydrostatic motor 58, which, in turn, controls rotation of the winch 42B. As the first set of implement-side ports 112E, 112F are not in use, the first set of implement-side ports 112E, 112F are blocked off by plugs 55 receivable in the ports 112E, 112F.

With the winch 42B coupled to the auxiliary hydraulic manifold 100, the control valve 50 of the vehicle 10 can control the operation of the auxiliary implement 42B. For instance, when the control valve 50 is in the first position (shown), the winch 42B is kept in its current rotational position. When the control valve 50 is in the second position, hydraulic fluid is fed from the pump 44 through the inlet auxiliary control line 48A, the vehicle-side inlet port 110, the first implement-side auxiliary port 112A, and the first hydrostatic supply line 56A to the hydrostatic motor 58, while fluid in the hydrostatic motor 58 is returned via the second hydrostatic supply line 56B, the second implement-side auxiliary port 112B, the vehicle-side outlet port 110B, and the outlet auxiliary control line 48B to the tank 46. Conversely, when the control valve 50 is in the third position, hydraulic fluid is fed from the pump 44 through the outlet auxiliary control line 48B, the vehicle-side outlet port 110B, the second implement-side auxiliary port 112B, and the second hydrostatic supply line 56B to the hydrostatic motor 58, while fluid in the hydrostatic motor 58 is returned via the first hydrostatic supply line 56A, the first implement-side auxiliary port 112A, the vehicle-side inlet port 110A, and the inlet auxiliary control line 48A to the tank 46. Generally, the winch 42B may be rotated in a first direction when fluid is supplied to the first hydrostatic supply line 56A and in a second, opposite direction when fluid is supplied to the second hydrostatic supply line 56B.

As such, the second set of the plurality of implement-side ports 112A, 112B, 112C, 112D is configured for hydraulic control of a hydrostatic motor (e.g., hydrostatic motor 58) while the first set of the plurality of implement-side ports 112E, 112F is not configured for hydraulic control of a hydrostatic motor. By using the auxiliary hydraulic manifold 100 disclosed herein, auxiliary implements having hydraulic configurations of a first type, such as hydraulic configurations without hydrostatic motors, and auxiliary implements having hydraulic configurations of a second type, such as hydraulic configurations with hydrostatic motors, may both be couplable to a work vehicle 10 without making any changes to the auxiliary hydraulic circuit 40 of the work vehicle 10. Thus, the auxiliary hydraulic manifold 100 significantly reduces the amount of time it takes to switch between auxiliary implements having different types of hydraulic configurations.

It should be appreciated that while the auxiliary implements are only shown as the ripper 42A and winch 42B, any other suitable auxiliary implements may instead, or additionally, be used with the auxiliary hydraulic manifold 100 described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for connecting different implements to a work vehicle for hydraulic control, the system comprising:

a work vehicle having a plurality of hydraulic auxiliary control lines; and an auxiliary hydraulic manifold hydraulically couplable to the work vehicle, the auxiliary hydraulic manifold having a plurality of vehicle-side ports and a plurality of implement-side ports, the plurality of vehicle-side ports including a vehicle-side pilot port, a vehicle-side tank port, a vehicle-side inlet port, and a vehicle-side outlet port, each of the plurality of vehicle-side ports being fluidly coupled to a respective one of the plurality of hydraulic auxiliary control lines, each of the plurality of vehicle-side ports being fluidly coupled to at least one respective implement-side port of the plurality of implement-side ports, wherein a first set of the plurality of implement-side ports is configured to be fluidly coupled to a first work implement, and a second set of the plurality of implement-side ports is configured to be fluidly coupled to a second work implement, wherein at least one of the first set of the plurality of implement-side ports is different from the second set of the plurality of implement-side ports.

2. The system of claim 1, wherein each of the first set of the plurality of implement-side ports is different from the second set of the plurality of implement-side ports.

3. The system of claim 1, wherein the first set of the plurality of implement-side ports includes a first implement-side check port fluidly coupled to the vehicle-side inlet port and a second implement-side check port fluidly coupled to the vehicle-side outlet port.

4. The system of claim 3, further comprising a first pilot-operated check valve fluidly coupled between the first implement-side check port and the vehicle-side inlet port and a second pilot-operated check valve fluidly coupled between the second implement-side check port and the vehicle-side outlet port.

5. The system of claim 1, wherein the second set of the plurality of implement-side ports includes an implement-side pilot port fluidly coupled to the vehicle-side pilot port, an implement-side tank port fluidly coupled to the vehicle-side tank port, a first implement-side auxiliary port fluidly coupled to the vehicle-side inlet port, and a second implement-side auxiliary port fluidly coupled to the vehicle-side outlet port.

6. The system of claim 1, further comprising plugs that are receivable in one or more of the second set of the plurality of implement-side ports when a first implement is connected to the work vehicle and in one or more of the first set of the plurality of implement-side ports when a second implement is connected to the work vehicle.

7. The system of claim 1, wherein the plurality of vehicle-side ports are on a vehicle-side of the auxiliary hydraulic manifold and the plurality of implement-side ports are on an implement-side of the auxiliary hydraulic manifold, the vehicle-side of the auxiliary hydraulic manifold being spaced apart from the implement-side of the auxiliary hydraulic manifold.

8. The system of claim 4, wherein the second set of the plurality of implement-side ports is configured for hydraulic control of a hydrostatic motor and the first set of the plurality of implement-side ports is not configured for hydraulic control of a hydrostatic motor.

9. An auxiliary hydraulic manifold for connecting different implements to a work vehicle for hydraulic control, the auxiliary hydraulic manifold comprising:

a housing;

a plurality of vehicle-side ports in the housing, the plurality of vehicle-side ports including a first vehicle-side port, a vehicle-side pilot port, and a vehicle-side tank port;

a plurality of implement-side ports in the housing, the plurality of implement-side ports including a first implement-side port fluidly coupled to the first vehicle-side port and a second implement-side port fluidly coupled to the first vehicle-side port, a number of the plurality of implement-side ports being greater than a number of the plurality of vehicle-side ports; and a pilot-operated check valve fluidly coupled between the first vehicle-side port and the first implement-side port.

10. The auxiliary hydraulic manifold of claim 9, wherein the first implement-side port and the pilot-operated check valve are fluidly coupled to the first vehicle-side port in parallel to the second implement-side port.

11. The auxiliary hydraulic manifold of claim 9, wherein the plurality of vehicle-side ports further comprises a second vehicle-side port, and wherein the plurality of implement-side ports further comprises a third implement-side port fluidly coupled to the second vehicle-side port and a fourth implement-side port fluidly coupled to the second vehicle-side port.

12. The auxiliary hydraulic manifold of claim 11, further comprising a second pilot-operated check valve fluidly coupled between the second vehicle-side port and the third implement-side port.

13. The auxiliary hydraulic manifold of claim 12, wherein the third implement-side port and the second pilot-operated check valve are fluidly coupled to the second vehicle-side port in parallel to the fourth implement-side port.

14. The auxiliary hydraulic manifold of claim 9, wherein the plurality of implement-side ports further comprises an implement-side pilot port fluidly coupled to the vehicle-side pilot port and an implement-side tank port fluidly coupled to the vehicle-side tank port.

15. The auxiliary hydraulic manifold of claim 9, wherein the housing has at least a vehicle-side and an implement-side, with the vehicle-side being spaced apart from the implement-side, the plurality of vehicle-side ports being on the vehicle-side of the housing and the plurality of implement-side ports being on the implement-side of the housing.

16. The auxiliary hydraulic manifold of claim 15, wherein the vehicle-side of the housing is opposite the implement-side of the housing.

17. A system for connecting different implements to a work vehicle for hydraulic control, the system comprising:

a work vehicle having a plurality of hydraulic auxiliary control lines; and an auxiliary hydraulic manifold hydraulically couplable to the work vehicle, the auxiliary hydraulic manifold having a plurality of vehicle-side ports and a plurality of implement-side ports, the plurality of vehicle-side ports being on a vehicle-side of the auxiliary hydraulic manifold, the plurality of implement-side ports being on an implement-side of the auxiliary hydraulic manifold, with the vehicle-side of the auxiliary hydraulic manifold being spaced apart from the implement-side of the auxiliary hydraulic manifold, each of the plurality of vehicle-side ports being fluidly coupled to a respective one of the plurality of hydraulic auxiliary control lines, each of the plurality of vehicle-side ports being fluidly coupled to at least one respective implement-side port of the plurality of implement-side ports, wherein a first set of the plurality of implement-side ports is configured to be fluidly coupled to a first work implement, and a second set of the plurality of implement-side ports is configured to be fluidly coupled to a second work implement, wherein at least one of the first set of the plurality of implement-side ports is different from the second set of the plurality of implement-side ports.

18. An auxiliary hydraulic manifold for connecting different implements to a work vehicle for hydraulic control, the auxiliary hydraulic manifold comprising:

a housing having at least a vehicle-side and an implement-side, with the vehicle-side being spaced apart from the implement-side;

a plurality of vehicle-side ports in the housing on the vehicle-side of the housing, the plurality of vehicle-side ports including a first vehicle-side port;

a plurality of implement-side ports in the housing on the implement-side of the housing, the plurality of implement-side ports including a first implement-side port fluidly coupled to the first vehicle-side port and a second implement-side port fluidly coupled to the first vehicle-side port, a number of the plurality of implement-side ports being greater than a number of the plurality of vehicle-side ports; and a pilot-operated check valve fluidly coupled between the first vehicle-side port and the first implement-side port.

* * * * *